US006854201B1

(12) United States Patent
Hunter et al.

(10) Patent No.: US 6,854,201 B1
(45) Date of Patent: Feb. 15, 2005

(54) CUTTING TOOTH FOR TRENCHER CHAIN

(76) Inventors: William D. Hunter, 311 Rutgers, Wichita, KS (US) 67212; Ronald C. Becker, 999 N. Silversprings Blvd., #411, Wichita, KS (US) 67212

( * ) Notice: Subject to any disclaimer, the term of this patent is extended or adjusted under 35 U.S.C. 154(b) by 0 days.

(21) Appl. No.: 10/696,137

(22) Filed: Oct. 30, 2003

(51) Int. Cl.[7] ..... E02F 3/14; E02F 9/28
(52) U.S. Cl. ..... 37/465; 299/34.01; 299/82.1
(58) Field of Search ..... 299/34.01, 84.1, 299/82.1; 37/465, 450

(56) References Cited

U.S. PATENT DOCUMENTS

| | | | | |
|---|---|---|---|---|
| 1,745,090 | A | | 1/1930 | Geithle |
| 2,330,081 | A | | 9/1943 | Phipps |
| 2,519,076 | A | | 8/1950 | Schmidt |
| 2,709,860 | A | | 6/1955 | Helton |
| 2,946,142 | A | | 7/1960 | Swanson |
| 3,022,588 | A | | 2/1962 | Brown |
| 3,614,838 | A | | 10/1971 | Wherry |
| 3,954,301 | A | | 5/1976 | Stepp |
| 4,476,642 | A | * | 10/1984 | Hemphill ..... 37/452 |
| 4,924,609 | A | | 5/1990 | Martin |
| 5,248,188 | A | * | 9/1993 | Walgren ..... 299/83.1 |
| 6,154,987 | A | | 12/2000 | Rumer et al. |

* cited by examiner

*Primary Examiner*—Christopher J. Novosad
(74) *Attorney, Agent, or Firm*—Edward L. Brown, Jr.

(57) ABSTRACT

A cutting tooth used on an endless chain-trenching machine to fracture and excavate the ground. The tooth includes a mounting portion for attachment to the chain and a cutting portion having a straight cutting edge at the leading end of the tooth positioned normal to the direction movement of the chain. The cutting portion is aligned from the mounting at an acute angle to the plane of the mounting portion and including convex surfaces on both sides of the cutting portion and a juncture line between the mounting portion and the cutting portion forms an acute angle with the direction movement of the chain whereby the cuttings produced by the tooth are lifted away by the chain as the chain is digging.

6 Claims, 3 Drawing Sheets

CUTTING TOOTH FOR TRENCHER CHAIN

FIELD OF THE INVENTION

This invention relates to a cutting tooth used on endless chain trenching machines. Teeth are affixed to the chain and driven into the soil to fracture and excavate the materials thereby forming a trench or ditch in which are laid underground pipe and cables.

BACKGROUND OF THE INVENTION

It is well established by practice within the trenching service industry that it is desirable for the trench-cutting device to fracture the soil and excavate the spoils efficiently. Most trenchers include a tractor unit equipped with an elongated boom, which supports an endless chain power driven over sprockets at opposing ends of the boom. Cutting teeth are removably affixed to the chain.

There have been many attempts to develop teeth that accomplish both functions, but they have either been more efficient at fracturing or excavating. The variety of soil conditions affects the performance of each type of tooth.

Some of the early tooth designs were derived from mining breaker teeth. These teeth were hardened with a small area of contact and were manufactured to fracture the minerals. Many times, after the soil was fractured, another operation using different teeth was required to remove the fractured spoils from the trench.

Many different styles of hardened ripper or breaking teeth have been manufactured, as illustrated in U.S. Pat. Nos. 2,330,081, to. Phipps, and 3,954,301, to Stepp, they exemplify pointed and hardened teeth that are retained by being inserted in a housing that is affixed to the chain links.

The most common cutters used for excavation of spoils from a trench are cup tooth cutters; as illustrated in U.S. patents to Schmidt, 2,519,076 and Brown, 3,022,588. They are made from flat plate and are formed in a concave shape, generally so that the leading end is larger in radial diameter than the trailing end. This conical shape serves to carry the spoils up from the bottom as the cutter is carried along the carrier chain. Cup tooth cutters are effective when used in soft soils, but because of the relative lack of rigidity and temper, they abrade and erode quickly when used on hard mineral soils. The shape acts as a scoop or cup in which loose soils are carried out of the trench and then expelled when the cutter is inverted. Loose soils tend to fall free of the cutter as the cutter orientation is changed due to traveling up the circular path of the carrier chain, thus spilling back into the trench from which they were just removed. The concave cup area also tends to hold wet clay and sticky soils as it packs into the shape. Those soils tend to remain in the cutter despite inverting the cutter and must sometimes be pried or jarred loose. When cuttings pack into the cutter in this manner, the cutter cannot carry additional materials and the effectiveness of the cutters is greatly diminished. The result of the cutters carrying the additional weight of the packed soils and the resistance caused by the cutters being full as they are moved through the soil add additional loads to the power system driving the carrier chain.

U.S. Pat. No. 2,709,860, to Helton, describes a cutter that is comprised of a cup tooth body with an excavating breaker point attached to its exterior. The stated intent of the cutter was to fracture and excavate the spoils. The effectiveness of this design is questioned.

There have been other types and styles of cutting teeth manufactured for use in cutting trenches, such as U.S. Pat. Nos. 1,745,090, to Geithle, and 2,946,142, to Swanson, which are examples of teeth that are fabricated as right angles. These cutters are oriented and affixed to the carrier chain so that one leg is parallel to the chain links and the other leg is perpendicular to that leg and the chain link. The effect as the cutter is carried by the chain through the soil is to slice through it. The ability to carry spoils to the surface is minimal. These cutters are also ineffective as hard mineral fracturing teeth due to the blunt and relatively thin forward edges that contact the soil.

U.S. Pat. Nos. 3,614,838, to Wherry; 6,154,987, to Rumer et al; and 4,924,609, to Martin, all define angular cutter teeth that are affixed to the carrier chain links and are oriented so that the planer cutting area is parallel to the link. The cutting area of these teeth is bent at an angle that serves to widen the surface of the tooth as it is pulled into the soil. The bent angle is intended to cause the soil to fracture as well as to lift and excavate the spoils as it travels up through the trench. In Wherry the bend line between the mounting portion and the cutting portion is parallel to the chain movement rather than an acute angle. The projection 34 on Wherry creates substantial drag on the chain. The patent to Rumer et al has very little, if any, lifting of the spoils as also does the tooth of Martin.

SUMMARY OF THE INVENTION

The present invention is a cutting tooth, also referred to as a cutter, that is especially designed to perform both fracturing or braking of the soil structures and then excavate or remove the spoils from the trenched opening.

The tooth is a complex shape which is broadly described as having a planer mounting portion for attachment to the carrier chain, and a cutting portion having two convex shaped surfaces that fair into the mounting portion and meet at a junction line which in elevation is oblique to the direction of movement of the chain. The mounting portion is a consistent thickness and is designed to facilitate the attachment of the tooth to carrier chains by the use of mechanical fasteners, such as bolts and nuts. The body of the cutting portion is shaped such that its opposite sides are convex shaped, causing the body to be of an irregular shape and much thicker than the mounting portion. Both sides are shaped so that the contours are diminished as they blend down to a constant thickness, mounting portion The top edge of the cutter is shorter on the trailing end than the cutting edge end such that the general side view presents the cutter as trapezoidal in shape. The trailing edge is perpendicular to the bottom edge of the mounting portion. The leading or cutting edge is substantially normal to the bottom edge such that the top corner extends forward slightly relative to the bottom of the cutting edge. This renders a slight forward angular rake to the cutter when viewed from the side. The convex shapes of the cutting portion blend into the mounting portion and form a slight concave area behind the convex area on one side where they meet. The shapes are blended or faired into each other. The height of the cutting portion and its angle with respect to its direction of movement is designed to be the minimal dimension that will enable the cutter to cut or fracture and lift the spoils. The lower profile is desirable as a means of reducing the drag of the cutter as it is carried through the soil. As the cutter is moved by the chain in contact with the soil, the leading cutting edge of the cutter slices and parts the soil. The cutting effect is as if it were slicing and scraping a kerf cut, not scooping or dragging as a cup or bucket cutter. The spoils are resultantly smaller and of a somewhat consistent size and shape like shavings or cuttings where are produced from drills and milling operations rather than balls or chunks. As the tooth is pulled further, those spoils thus dislodged are swept across the convex shape of the body. The curved shape allows the spoils to flow across the cutter with less resistance and also carries the spoils upward on the sidewalls just cut by the leading cutting edge. Because of the convex shape of the cutter surfaces, the spoils do not stick or adhere to it as they do in cups or scoops. The spoils ride up out of the trench on the convex surfaces and therefore are expelled without being reintroduced into the trench when the cutter is inverted during the chain travel. The slight forward rake of the leading edge of the tooth serves to act as a breaking point for harder soil structures. The conjunctive corner meets in a compound point that fractures the medium upon impact. The spoils are then carried up and away as described above.

Other cutters are comprised of either a common non-tempered steel with an area adjacent to the cutting plane coated or treated with a hard surfacing material, or are designed to accommodate an insert or removable hardened component.

The cutter described therein is manufactured from a special alloy that is then heat treated and tempered to achieve high strength and hardness. The entire cutter tooth is of the same consistent temper and tensile strength, not just certain areas. This material and the heat treatment render a cutter that is stronger, harder, and more durable than carbon steel formed plate cutters.

This homogeneous structure can be resharpened when it starts wearing from use, thereby extending the useful life. The sharpening method can be achieved with the teeth installed on the trencher chain by passing a hand held grinder over the forward angular cutting face or by removing and grinding and then reinstalling. The regrinding process removes the dulled surface and relieves the material back to reform a new cutting plane beneath the previous one.

This cutter cannot be formed by bending plate material but will be manufactured by either casting, forging, molding, machining or otherwise cutting from a billet of assembling as a welded fabrication.

The principal object of the present invention is to provide a tooth with more efficient trenching production, with less power requirements from the drive system, and better spoils excavation.

Another object of the invention is the provide a more versatile tooth that cuts both soft soils and rocky soils while providing excellent spoils excavation with minimum back fall in the trench.

A further object of the invention is to provide a tooth that does not pack-up in wet clays and other soft soils.

Another object of the invention is to provide a longer life tooth of extreme hardness that can be resharpened.

Further objects and advantages will be apparent in the following detailed description.

DETAILED DESCRIPTION

Figure 7:
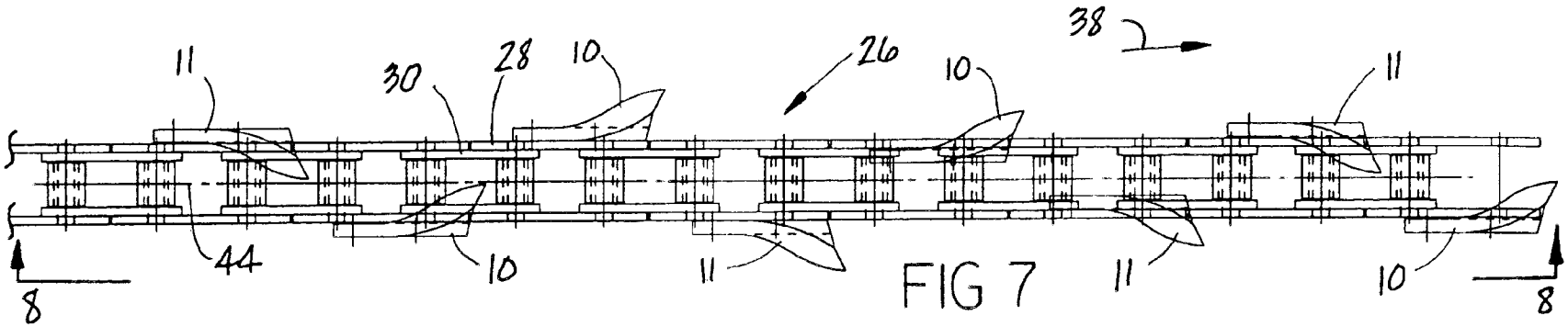
FIG. 7 is a top view of a conventional chain with the teeth of the present invention mounted thereon.
Figure 8:
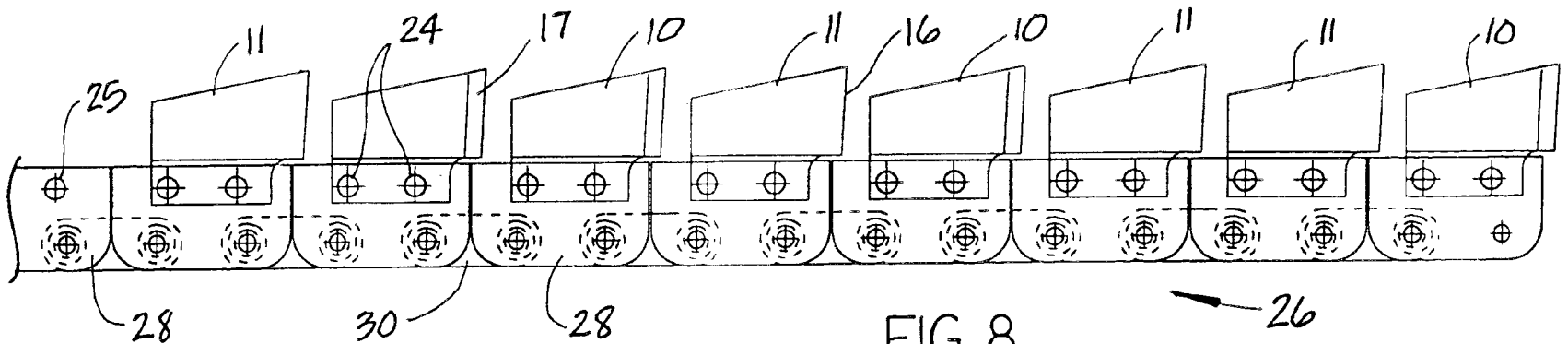
FIG. 8 is a side elevational view taken along line 8—8 of FIG. 7.

FIGS. 7 and 8 show top and side views of a conventional trencher chain generally identified by reference numeral 26 which supports a plurality of the trencher teeth of the present invention which are identified by reference numerals 10 and 11, one being the mirror image of the other. Trencher chains are typically used by trenchers in the prior art, such as illustrated and described in U.S. Pat. No. 6,154,987. The chain is supported by two sprockets located at opposite ends of a boom, which drive the chain in the direction indicated by arrow 38. In it's digging function the chain 26 operates upside down from its FIG. 8 position with the chain exiting the ground at an acute angle to the surface, which then rides around a sprocket and reverses its direction traveling back into the previously cut trench.

Chain 26 includes mounting links 28 connected by smaller bridging links 30 with bolts that connect the links but are not shown. Mounting links 28 include a pair of mounting holes 25 whereby the teeth 10 or 11 are bolted thereto through mounting holes 24 in the teeth. Trenching tooth 11 is identical to trenching tooth 10 except that its cutting portion extends from the opposite side as seen in FIG. 7

FIGS. 1 through 6 illustrate trenching tooth 10. FIG. 7 illustrates a tooth arrangement on chain 26 wherein both trenching teeth 10 and 11 are utilized in a specific sequence pattern. Other mounting sequences of the teeth are possible depending upon various factors such as trench width and soil conditions.

Figure 3:
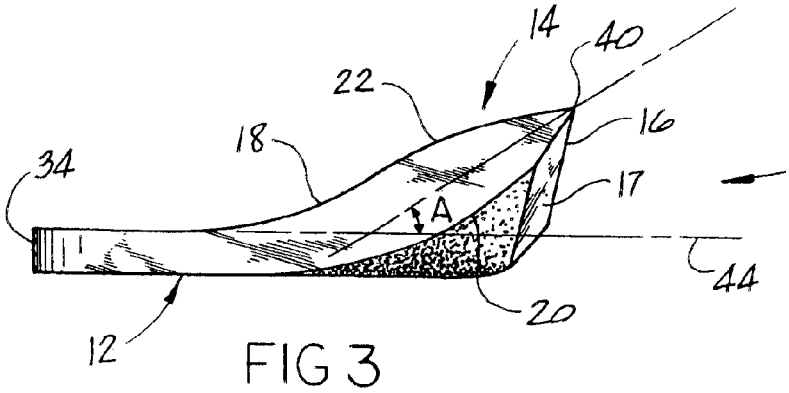
FIG. 3 is a top view of the tooth illustrating the two convex surfaces.
Figure 1:
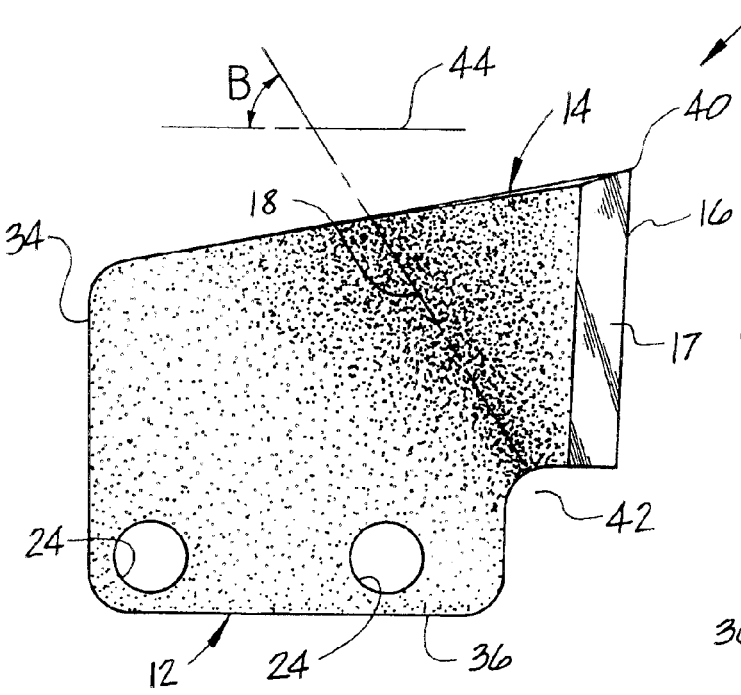
FIG. 1 is a side elevational view of the tooth of the present invention.
Figure 2:
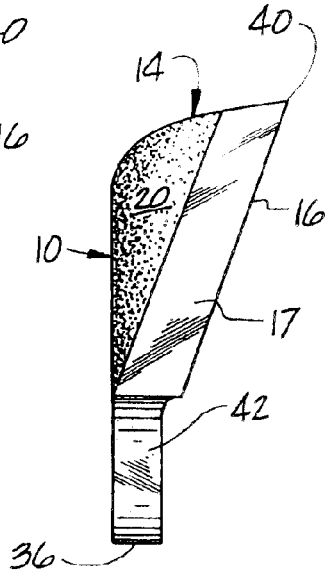
FIG. 2 is a front end view of the tooth.
Figure 4:
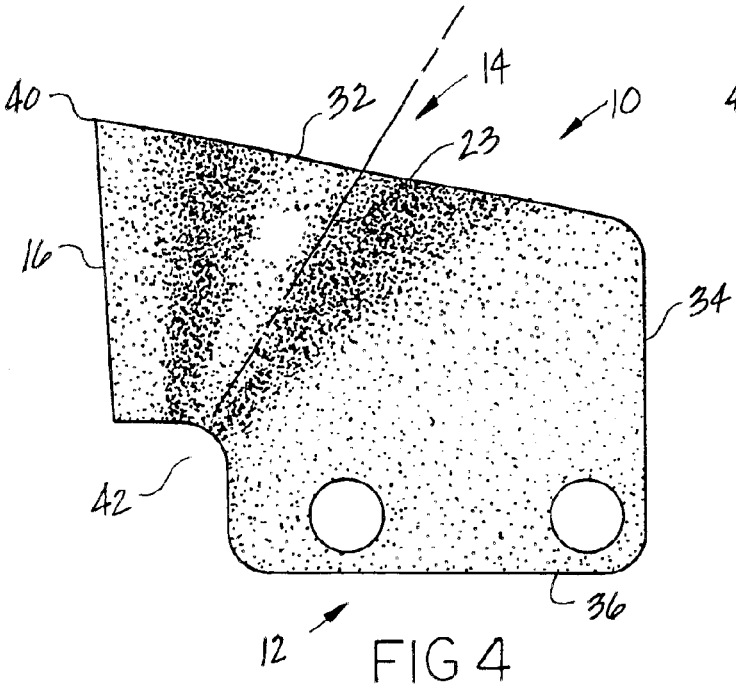
FIG. 4 is an opposite side elevation of the tooth.
Figure 6:
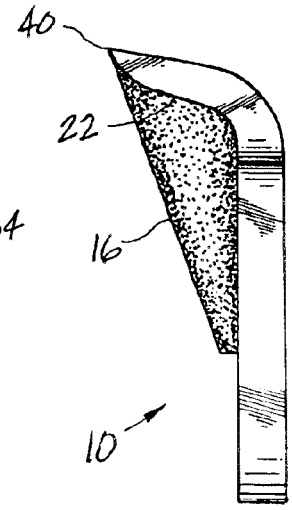
FIG. 6 is a rear end view of the tooth.
Figure 5:
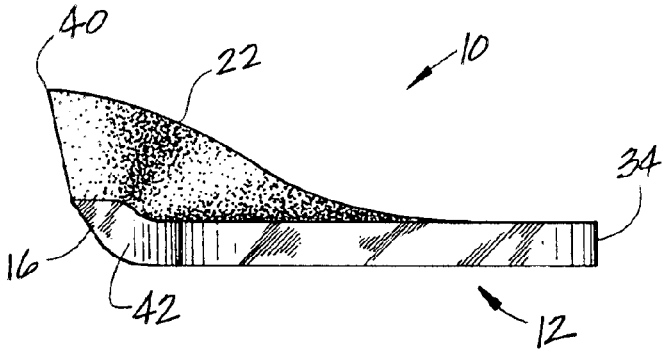
FIG. 5 is a bottom view of the tooth.

Referring to FIGS. 1 through 6, trenching tooth 10 includes a planer-mounting portion 12 of uniform thickness, which extends from the bottom edge of the tooth 36 in FIG. 1 all the way up to the trailing edge 34 of the tooth. The mounting portion 12 of the tooth is combined with a cutting portion 14 which includes a leading or cutting edge 16 in a position substantially normal to the axis 44 of movement of the chain 26. The cutting portion 14 is positioned at an acute angle A to the mounting portion 12 as shown in FIG. 3. The top edge 32 of the tooth is planar, sloping downward from its leading edge 16 to its trailing edge 34 as seen in FIG. 1. Cutting portion 14 varies in thickness as seen in FIG. 3 having convex surfaces 20 and 22 on opposite sides thereof both of which blend into the mounting portion 12. Located between mounting portion 12 and cutting portion 14 is a juncture line 18 as seen in FIG. 1 which line is located at an acute angle B to the axis 44 of chain movement. Due to this angle the tip 40 of the cutting portion extends further outward from the plane of the mounting portion 12. The cutting edge 16 is caused by grinding surface 17, which can be reground when edge 16 becomes dull.

The convex surfaces 22 and 20 on the cutting portion prevent soft soils from collecting and building up on the cutting teeth as they do on concave shaped cup teeth as the chain reverses directions in an inverted position and proceeds back into the trench.

Due to the forged shaped of tooth 10 and its ground surface 17, a breaking point 40 is formed on the upper edge of the tooth with relatively wide angles of tooth material between 45° and 60° sloping away therefrom thereby providing a strong and rigid fracturing point for breaking rocky soils.

The action of cutting teeth 10 or 11 in softer soils is a shaving action whereby the cutting edge 16 and adjacent convex surface 20 force the cut materials to the side.

In viewing chain 26 from a plan view as seen in FIG. 7, a varying arrangement of teeth 10 and 11 are provided on opposite sides of the chain with some of the cutting portions aimed inward and others aimed outward. Also, the path the tooth travels can be varied by mounting the tooth on the outside of mounting link 28 or the inside of mounting link 28 so that the tooth does not extend so far outward. The teeth can be extended even further outward with the use of filler plates between the tooth and the link 28. Teeth 10 and 11 include a notch area 42 located approximate the cutting edge 16 of the tooth whereby the cutting edge 16 first contacts the soil being fractured and excavated. The breaking point 40 at the upper end of the cutting edge 16 is tilted slightly forward so that it comes in contact first with the soil being fractured.

With regard to the foregoing description it is to be understood that changes may be made for different arrangements of the teeth on the chains and materials employed in the manufacture of the teeth without departing from the scope of the present invention. It is intended that the specification and the depicted aspects be considered exemplary only, with the actual scope and spirit of the invention being defined in the meaning of the following claims.

We claim:

1. A removable tooth having leading and trailing ends utilized on a linear movement endless trencher chain:

a planar mounting portion that attaches to the chain and lies in a plane of movement of the trencher chain;

a cutting portion having a straight cutting edge at the leading end of the tooth positioned substantially normal to the direction of movement of the chain, the cutting portion being aligned from the mounting portion at an acute angle to the plane of the mounting portion and having convex surfaces on both sides of the cutting portion and;

a junction line between the mounting portion and the cutting portion which forms an acute angle with the direction of movement of the chain in a vertical plane whereby the cuttings produced by the tooth are lifted away from the chain as the chain is digging.

2. A removable trenching tooth as set forth in claim 1, wherein the cutting edge of the tooth has a constant bevel along its length of between 45° and 60°.

3. A removable trenching tooth as set forth in claim 1, which can be used on opposite outer sides of the trencher chain.

4. A removable trenching tooth as set forth in claim 1, formed by any one of the methods of casting, forging, molding or machining.

5. A removable trenching tooth as set forth in claim 1, including a planar top edge sloping upward from the trailing end that joins the leading end of the tooth at an acute angle forming a breaking point for fracturing the soil.

6. A removable trenching tooth having leading and trailing ends utilized on a linear movement endless trencher chain:

a planar mounting portion that attaches to the chain and lies in a plane of movement of the trencher chain;

a cutting portion having a straight edge at the leading end of the tooth positioned substantially normal to the direction of movement of the chain, the cutting portion being aligned from the mounting portion at an acute angle to the plane of the mounting portion, and;

a junction line between the mounting portion and the cutting portion which form an acute angle with the direction of the movement of the chain in a vertical plane whereby the cuttings produced by the tooth are lifted away from the chain as the chain is digging.

* * * * *